United States Patent [19]

Appel

[11] 4,393,926

[45] Jul. 19, 1983

[54] CLOVER HEAT EXCHANGER CORE

[76] Inventor: Gary H. Appel, 2235 W. 25th St., San Pedro, Calif. 90732

[21] Appl. No.: 251,354

[22] Filed: Apr. 6, 1981

[51] Int. Cl.[3] ..... F28D 7/00; F28D 7/10

[52] U.S. Cl. ..... 165/165; 165/172; 165/177

[58] Field of Search ..... 165/157, 164, 165, 166, 165/179, 183, 172, 177

[56] References Cited

U.S. PATENT DOCUMENTS

| | | | |
|---|---|---|---|
| 2,332,336 | 10/1943 | Norris | 165/141 |
| 2,998,228 | 8/1961 | Huet | 165/183 X |
| 3,414,052 | 12/1968 | Chojnowski et al. | 165/164 |

FOREIGN PATENT DOCUMENTS

| | | | |
|---|---|---|---|
| 559470 | 8/1957 | Belgium | 165/172 |
| 1085900 | 7/1960 | Fed. Rep. of Germany | 165/177 |
| 911987 | 12/1962 | United Kingdom | 165/179 |

*Primary Examiner*—William R. Cline
*Assistant Examiner*—Theophil W. Streule, Jr.

[57] ABSTRACT

A heat exchanger including the multiplicity of elongate laterally spaced parallel tubes, each of which is formed with circumferentially spaced longitudinally extending radially outwardly projecting lobes which are semi-circular in cross-section and circumferentially spaced longitudinally extending radially outwardly opening intermediate grooves which are semi-circular in cross-section and wherein related lobes and grooves of adjacent tubes are interengated with their opposing semi-circular surfaces in uniform spaced relationship from each other whereby a labyrinth of passages of substantially uniform cross-section, through which a fluid medium can flow, occur about and between all adjacent related tubes whereby more uniform lateral flow of a fluid medium about and between adjacent tubes is attainable.

9 Claims, 10 Drawing Figures

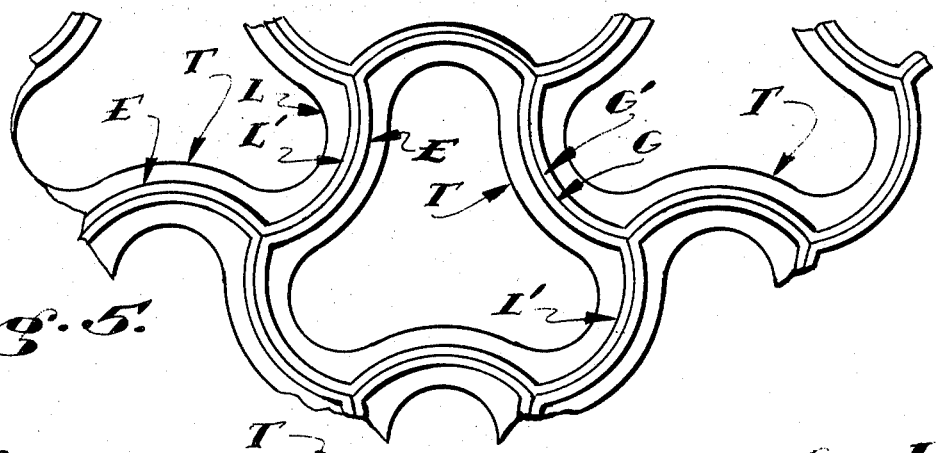
Fig. 5.
Fig. 4.
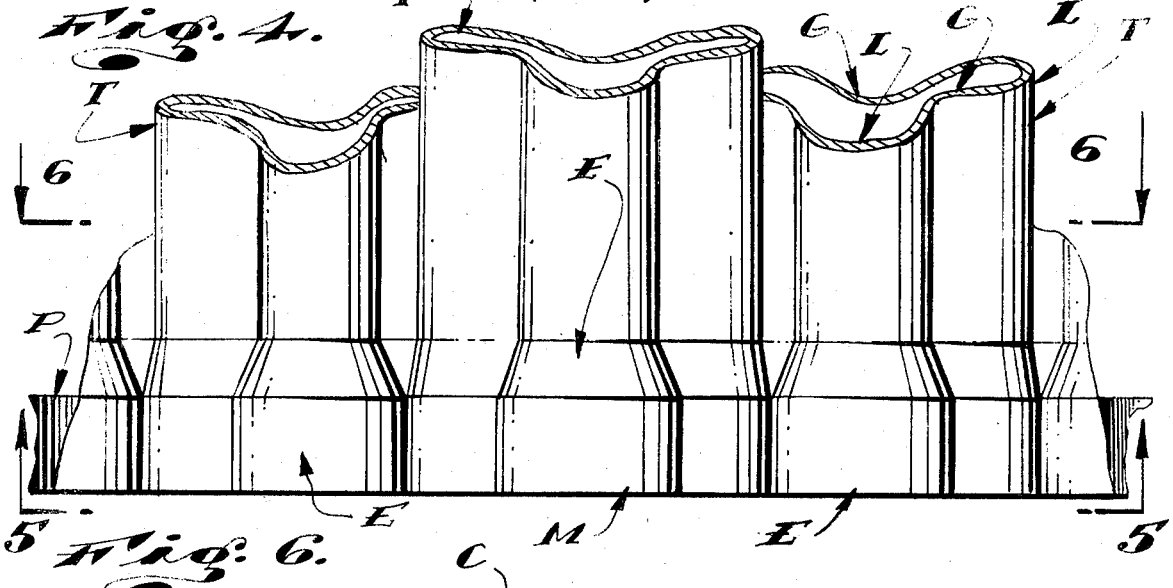
Fig. 6.
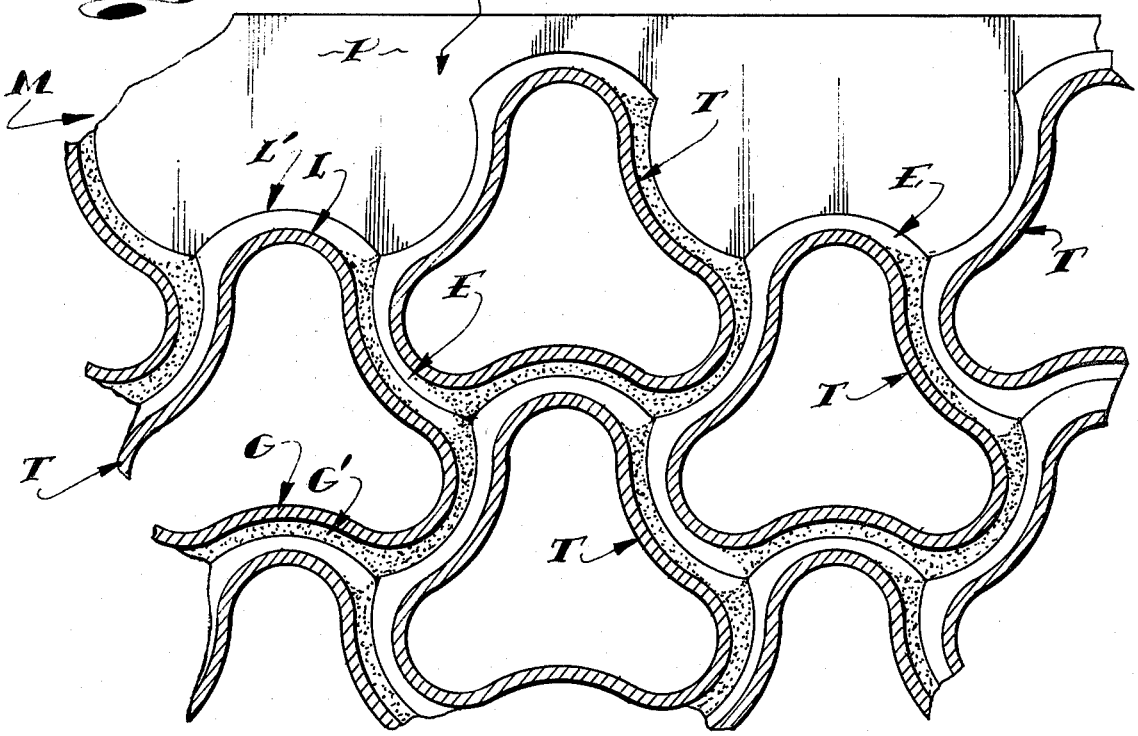

CLOVER HEAT EXCHANGER CORE

This invention has to do with heat exchangers and is particularly concerned with a novel and improved compact and highly efficient heat exchanger structure with longitudinally fluted tubes in spaced meshed relationship.

BACKGROUND OF THE INVENTION

The ordinary heat exchanger of the class here concerned with comprises a plurality of elongate parallel, laterally spaced fluid conducting tubes extending through a fluid conducting chamber or the like.

The tubes are established of material having high indices of heat conduction and have inlet and outlet ends communicating with means provided to conduct a first fluid medium to and from the tubes. The chamber through which the tubes extend has upstream and downstream ends communicating with means provided to conduct a second fluid medium through the chamber and about the exterior of the tubes.

In the ordinary heat exchanger, the tubes are straight, cylindrical in cross-section and are spaced one from the other a sufficient distance to afford most effective and efficient flow of the second fluid medium about and between them.

The cylindrical cross-section and required spacing of the tubes of ordinary heat exchangers determines and limits their density or surface compactness and their resulting efficiency, size and weight.

The cylindrical cross-section and required spacing of the tubes or ordinary heat exchangers work material limitations on the effectiveness and efficiency of the heat exchange attainable thereby and present inherent problems with respect to the headering or mounting of the ends of the tubes.

In accordance with and in furtherance of the foregoing, in heat exchangers of the character referred to above wherein the second medium is caused to flow about the tubes in a direction normal to the axes thereof, the spaces between the tubes have flow limiting or restricting effect which requires that the tubes be spaced a substantial distance apart and requires that the resulting heat exchanger structures be quite large, dimensionally. Further, such spacing of the cylindrical tubes results in a labyrinth-like series of passages of irregular shape defined by the cylindrical surfaces of adjacent related tubes. The irregular shape of the passages cause eddy currents and turbulence in the fluid medium flowing therethrough, which eddy currents and turbulence not only prevent uniform and efficient heat exchange, but also cause friction losses, attending pressure drop and the generation of heat, which adversely affect the efficiency and effectiveness of the heat exchangers.

The required spaced relationship of the tubes in ordinary heat exchangers requires the provision and use of costly complicated headering means for mounting the ends of the tubes which headering means most commonly include heavy complicated and costly to make header plates with multiplicities of through openings therein to receive and establish sealed engagement with the ends of the tubes related thereto. In such structures, each end of each tube must be separately engaged in a related opening in its related header plate and effectively fixed and sealed therein. Such a procedure of manufacture and/or assembly is time consuming, requires the exercise of special skills and is extremly costly. Further, the resulting structures are most often rather weak, subject to adverse thermal stresses and failure prone.

The art of heat exchangers of the general class here concerned with is extremely old and crowded. Throughout the years, to the present time, a great amount of time and engineering skill has been expended in the design and construction of heat exchanger structures. Throughout the years, there has long been a recognized want and need for exchangers having greater density or surface compactness than can be effectively attained with cylindrical tubes, but to date, the prior art has failed to provide a heat exchanger structure capable of attaining that end.

OBJECTS AND FEATURES OF THE INVENTION

An object of my invention is to provide a novel heat exchanger structure of the general class here concerned with wherein the surface compactness, density or tube concentration in a specific area can be made notably greater than is possible in heat exchangers made in accordance with the teachings of the prior art.

Another object and feature of my invention is to provide a heat exchanger of the general character referred to above including the multiplicty of elongate laterally spaced parallel tubes, each of which is formed with circumferentially spaced longitudinally extending radially outwardly projecting lobes which are semi-circular in cross-section and circumferentially spaced longitudinally extending radially outwardly opening intermediate grooves which are semi-circular in cross-section and wherein related lobes and grooves of adjacent tubes are interengaged with their opposing semi-circular surfaces in uniform spaced relationship from each other whereby a labyrinth of passages of substantially uniform cross-section, through which a fluid medium can flow, occur about and between all adjacent related tubes whereby more uniform lateral flow of a fluid medium about and between adjacent tubes is attainable.

Yet another object and feature of my invention is to provide a heat exchanger of the character referred to above wherein the end portions of the tubes are expanded or otherwise enlarged and formed so that opposing adjacent surfaces of adjacent tubes are in substantial uniform engagement with each other and are suitably fixed together to effect a simple and highly effective headering or mounting of the ends of the tubes which is light-weight and affords little heat sink effect and resulting thermo stress.

Still another object and feature of this invention is to provide a heat exchanger of the general character referred to wherein the lobes and/or grooves in the tubes are formed with longitudinally spaced longitudinally and circumferentially extending helical depressions entering the exterior surface of the tubes and forming inwardly projecting helical vanes in the interior of the tubes to induce turbulation or changes in the direction of flow of the fluid medium within the tubes and to thereby assure effective and efficient heat exchange between the medium and the tubes.

Still another object and feature of this invention is to provide a heat exchanger of the general character referred to above wherein the lobes in the tubes are formed with longitudinally spaced helically or spirally extending depressions entering the exterior surfaces of said lobes and forming inwardly projecting helically extending vanes in the interior of the lobes to induce the medium in the lobes to rotate or swirl and to thereby drive and cause the medium in the central areas of the tubes, between the several lobes, to turbulate and/or rotate, whereby the medium in and throughout the tube structures establish intimate heat exchanging scrubbing contact with the walls of the tubes.

Another object and feature of my invention is to provide a heat exchanger of the general character referred to above wherein expansion (bulging) and/or distortion of the fluted tubes caused by high internal pressure is prevented by central perforated support tubes within the fluted tubes, which support tubes are engaged and fixed to the innermost portions of the fluted tubes, between the lobes thereof.

Finally, it is an object of my invention to provide a heat exchanger of the general character referred to above wherein central supporting and flow conducting tubes are arranged within and extend longitudinally through the fluted tubes whereby two different fluid mediums can be effectively conducted longitudinally through the tube assemblies.

The foregoing and other objects and features of my invention will be fully understood from the following detailed description of typical preferred forms and applications of my invention, throughout which description reference is made to the accompanying drawings:

DESCRIPTION OF THE DRAWINGS

FIG. 4 is a plan view showing the end portions of a plurality of related tubes;

FIG. 5 is a view taken substantially as indicated by line 5—5 on FIG. 4;

FIG. 6 is a sectional view taken substantially as indicated by line 6—6 on FIG. 5;

DETAILED DESCRIPTION OF THE INVENTION

Figure 1:
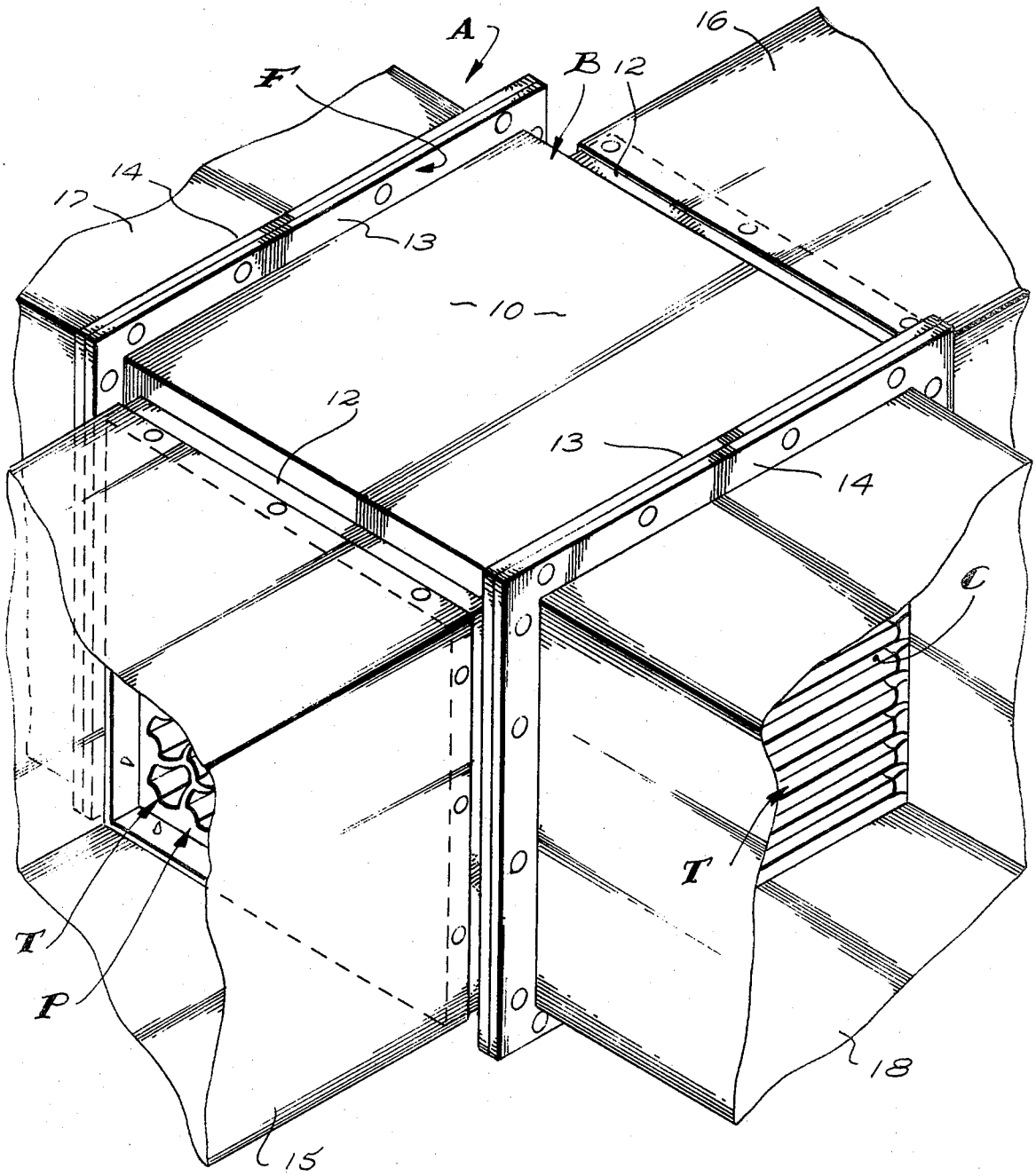
FIG. 1 is an isometric view of a heat exchanger having portions broken away to better illustrate the construction.

In FIG. 1 of the drawings, I have shown a simple form of heat exchanger A embodying my invention. The heat exchanger A includes a chest B comprising an open frame F of angle iron or the like. The frame F has or defines flat horizontal top and bottom sides, flat vertical ends and flat vertical sides. The top and bottom sides of the open frame are closed by flat top and bottom walls 10 of sheet metal or the like. The open ends and open sides of the frame F are defined by mounting flanges 12 and 13 which can be formed integrally with the frame and which extend about the perimeter portions of the said sides and ends of the frame and which project therefrom for easy access.

The chest B defines a chamber C with closed horizontal top and bottom sides, open vertical opposite ends and open vertical opposite sides. The ends of the chest are closed by square or rectangular header plates P having outer perimeter portions suitably fastened to the flanges 12. The header plates sealingly engage and support a multiplicity of elongate, longitudinally extending, laterally spaced parallel tubes T which extend longitudinally through the chamber C. The ends of the tubes are open and are disposed longitudinally outward at the opposite ends of the chest B. The pair of header plates P and the multiplicity of tubes T establish what is commonly referred to as a core assembly. The header plate P at one end of the case B is connected with the delivery end of a fluid supply duct 15 and the other plate P at the other end of the chest is connected with the receiving end of a fluid delivery duct 16. The header plates P are connected and/or releasably secured with their related ducts 15 and 16 by screw fasteners or the like in accordance with common practice.

One open side of the chest is connected with the delivery end of a fluid coolant supply duct 17 and the other side of the chest is connected with the receiving end of a fluid coolant exhaust duct 18. The ducts 17 and 18 are provided with flanges 14 at their ends which engage and which are suitably secured to the flanges 13 at the opposite sides of the chest, as by screw fasteners or the like.

In operation, a fluid medium, such as oil which is to be cooled, is caused to flow through and from the duct 15 into and through the multiplicity of tubes T and thence from the tubes T into and through the duct 16. At the same time, a second fluid medium or coolant, such as air, is caused to flow through and from the duct 17 into and laterally through the chamber C, about the tubes T extending longitudinally therethrough and thence out of the exchanger, into and through the duct 18. The heat to be removed from the first fluid medium or oil is absorbed by the walls of the tubes T as that medium flows therethrough. The heat absorbed by the tubes is conducted into or is absorbed by the air or second fluid medium flowing through the chamber C and about the tubes and is carried away by the second medium as it is advanced out of the chamber X into and through the duct 18.

It is to be noted that the heat exchanger structure A shown in the drawings and briefly described above is but one simple and rather basic form of heat exchanger structure in which my invention can be effectively embodied. It is anticipated and believed apparent that in practice, the number of different forms of heat exchangers in which my invention can and will be incorporated is great and that the differences in structural details that will be encountered when putting my invention into practice will be many.

The present invention relates primarily to the form of the tubes T, the cooperative relationship of those tubes relative to each other, and to the headering means employed to effect mounting of the ends of the tubes. In accordance with the foregoing, further detailed illustration, description and other consideration of the overall heat exchanger structure can and will be maintained at a minimum.

Figure 2:
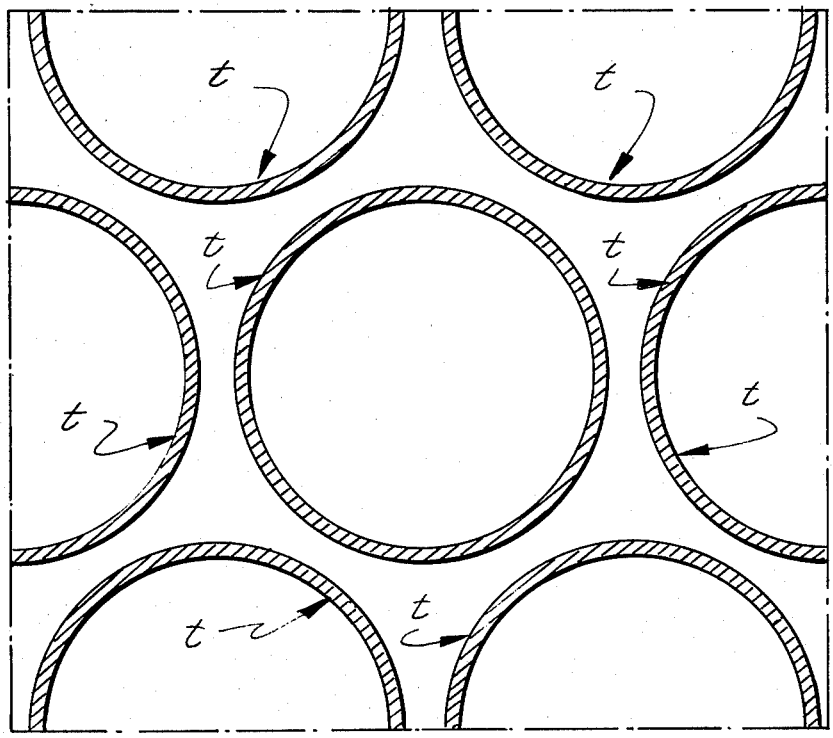
FIG. 2 is a cross-sectional view of a plurality of related heat exchanger tubes provided by the prior art, within a limited predetermined cross-sectional area.

In FIG. 2 of the drawings, for purposes of illustration and comparison, I have illustrated the cross-section and relative relationship of a plurality of common, cylindrical, heat exchanger tubes t as provided by the prior art. For purpose of example, it will be assumed that the outside diameter of the tubes t is 2.50 inches and the wall thickness thereof is 0.20 inches. The minimum distance or clearance between adjacent tubes t is 0.625 inches. One full tube and one-half of six tubes are shown arranged in an area of (for example) 25.25 square inches (measuring 5.4 inches by 5.67 inches). There is shown the equivalent of four complete tubes. The effective inside cross-sectional area of each tube is 4.15 square inches and the total inside cross-sectional area of the several tubes is therefore 16.61 square inches. Accordingly, the total cross-section of all of the tubes occupy or use 65.78% of the 25.25 square inch area within which they are arranged.

When considering the prior art structure illustrated and described above, the relative spacing or clearance provided between related tubes t is a critical and controlling factor with respect to the effectiveness and efficiency of the heat exchanger. Spacing of the tubes, one from the other, functions to limit or meter the flow of coolant laterally through the assembly of tubes and determines the pressure drop which is to be encountered through the assembly of tubes and the resultant efficiency of the heat exchanger.

Figure 3:
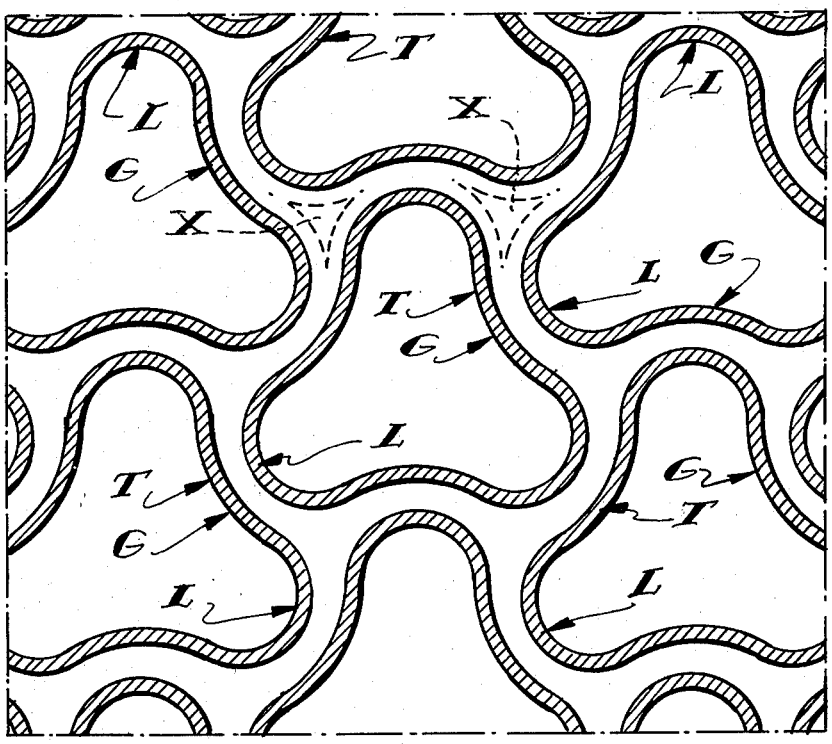
FIG. 3 is a cross-sectional view of a plurality of related heat exchanger tubes embodying a preferred form of my invention, within a certain predetermined cross-sectional area.

In FIG. 3 of the drawings, I have shown a plurality of tubes T (or portions of tubes) embodying my invention. The tubes in FIG. 3 are those tubes which occur within a field or area of 25.25 square inches.

The tubes T are established of 2.50 inches OD tubing with 0.20 inches walls and they are arranged with 0.625 inches clearance, one from the other.

Still further, the cylindrical or tubular surface area of each tube T, like the tubes t, is 7.85 inches per linear inch. To the above extent, the structure of my invention shown in FIG. 3 of the drawings is comparable to the prior art structure shown in FIG. 2 of the drawings.

In my invention, as shown in the drawings, the tubes T are formed radially inwardly along three circumferentially spaced lines to define three circumferentially spaced longitudinally extending and radially outwardly opening semi-circular grooves G and to leave or define three circumferentially spaced, longitudinally extending and radially outwardly projecting substantially semi-circular lobes L.

In the example illustrated, the tubes T are formed so that while the tubular surface area is the same as the tubular surface area of the prior art tubes t, their effective cross-sectional area is 3.50 square inches or 0.64 square inches less than that of the tubes t.

As shown in FIG. 3 of the drawings, due to the unique clover leaf cross-section and interengaged relationship of the several tubes T, the equivalent of seven tubes are arranged within the same total area (25.2554 inches) occupied by the four tubes t shown in FIG. 2 of the drawings. As a result, the total tubular surface area afforded by the seven tubes T is 55 square inches or very close to being twice the 31.41 square inches in the example shown in FIG. 2 of the drawings. Also, the total cross-sectional area of the seven tubes T is $7\times3.5$ or 24.5 square inches or about 33% greater than that afforded in the example of the prior art shown in FIG. 2 of the drawings.

In my new structure, shown in FIG. 3 of the drawings, the tubes T occupy and use 97% of the total area which they occupy as compared with 65.78% in the comparative example of the prior art.

The following is a comparative showing of data pertaining to comparable round and fluted tube structures within an area of 25.25 square inches:

25.25 Square Inch Area Used As Comparison Between Round And Fluted Tubing

| | Round | Fluted | Percentage Increase Round 100% |
|---|---|---|---|
| Inside area | 16.62 sq. in. | 17.01 sq. in. | 102.3% |
| Occupied area | 19.635 sq. in. | 21.358 sq. in. | 108.8% |
| Linear circumference | 31.42 in. | 54.978 in. | 175% |
| Applied occupied area 100%—25.25 sq. in. | 77.8% | 84.6% | 108.7% |
| Number of tubes | 4 | 7 | 175% |

In accordance with the above, it will be apparent that the effectiveness and efficiency of my new structure is about twice that of the prior art and that by altering the shape or proportioning of the cloverleaf cross-section of the tubes and the relative spacing of related tubes, the density or surface compactness of heat exchangers embodying my invention can be increased and decreased to a substantial extent, as desired or as circumstances require.

Upon examining the shape and relationship of the tubes T in FIG. 3 of the drawings, it will be noted that the passages between related portions of adjacent tubes (which make up the labyrinth of passages between the tubes providng for lateral flow of coolant) are substantially uniform in cross-section and such that the coolant is caused or made to flow substantially uniformly about and in heat transfer or scrubbing contact with the whole of the exterior surface of the tubes T and is not caused to be worked by repeated compression and expansion as it flows laterally about and between the tubes, as is the case in the prior art.

Further, the passages are such that enlarged open areas are not presented where extensive zones of minus pressure are likely to develop adjacent extensive portions of the tubes to inhibit and/or adversely interfere with effective heat exchange, as occurs at the downstream sides of the cylindrical tubes t shown in FIG. 2 of the drawings.

The pressure drop in the coolant moving laterally through or across the tubes T is primarily attributable to friction loss generated by the heat exchanging scrubbing action of the coolant on and about the exterior surfaces of the tubes and is secondarily attributable to the changing of direction of flow of the coolant. A negligible amount of pressure drop is attributable to idle turbulence and/or the extensive expansion and compression of the coolant, which is a major factor in the pressure drop which occurs in coolants in heat exchangers of the prior art. In accordance with the foregoing, the present invention is notably more effective and efficient with respect to the lateral flow of coolant about and between the tubes T.

In practice, the several tubes T are alike and each is formed from a length of round or cylindrical tube stock. In one preferred method of making a tube T, the tube stock can be suitably engaged about an enlongate mandrel which substantially corresponds in cross-section with the inside cross-section of the tube T to be formed. Thereafter, a carriage on a way, in spaced parallel relationship with the mandrel and carrying three rollers with semi-circular peripheral surfaces substantially corresponding with the shape of the grooves to be formed in the tube stock and on planes parallel with the central longitudinal radial planes of the grooves to be formed in the mandrel, is moved into engagement about one end of the mandrel supported tube stock. The rollers are then shifted radially inwardly to form adjacent portions of the tube stock into the grooves in the mandrel. Thereafter, the carriage and rollers are moved longitudinally of the mandrel and tube stock to form the several grooves C and lobes L in the tube stock, as desired. Thereafter, the formed tube is drawn from engagement on the mandrel.

In practice, the outside cross-sectional radius of the several grooves G is greater than the outside cross-sectional radius of the several lobes L by a distance equal to the space or clearance that is to be maintained between the lobes and grooves of adjacent tubes when the tubes are assembled. The grooves G can be made greater than 180° in circumferential extent between the ends of their circular, concave outer surfaces. In practice, the depth of the grooves G can be varied. If the grooves Gare shallow, the outer circular convex surface of the lobes L may be less than 180° in circumferential extent while if the grooves G are formed deep, the convex surfaces of the lobes L are likely to be greater than 180° in the circumferential extent. In practice, it is preferred that the radius of the grooves G and lobes L and the depth of the grooves be such that the radii of the grooves join tangentially or meet direct with the radii of their related lobes and that no flat or straight intermediate portions be established or formed therebetween.

In practice, forming of deep grooves with radiused bottoms and flat parallel sides which extend radially outward to tangentially meet the radii of their related lobes is both possible and practice, if such is desired.

In practice, the spaces which occur centrally between each three adjacent related lobes of each three adjacent related tubes T enlarges slightly. The extent of the enlargement as shown at X in FIG. 3 of the drawings, is an equilateral triangular window with convex sides, the axes of which are coincidental with the axes of related lobes and the radii of which are coincidental with the central or mean radii of the spaces between their related lobes and grooves. The extent of the windows X noted above is so slight as to present no notable problem or adverse effects. The windows X occur where the flow of coolant might tend or be caused to divide as it advances downstream through the spaces between each related lobe and groove toward the next pair of related lobes and grooves directely downstream thereof and it is believed that it facilitates dividing of the coolant as it advances downstream and laterally between the tubes.

The headering means M that I provide to securely mount the open end portions of the tubes T at their related ends of the case B includes elongate enlarged end portions E at the opposite ends of the tubes T. The end portions E are characterized by longitudinally extending grooves G' and lobes L' of limited longitudinal extent and the radii of which are equal. The radii of the lobes L' is greater than the radii of the lobes L a distance equal to one-half the clearance between the related lobes and grooves L and G of adjacent tubes and the radii of the grooves G' is less than the radii of the grooves G a distance equal to one-half the clearance between related lobes and grooves L and G. Accordingly, the radii of the lobes and grooves L and G' are alike and complimentary so that opposing surfaces of related interengaged lobes and grooves L' and G' of adjacent tubes T, in a heat exchanger, establish close uniform engagement with each other. In practice, the enlarged end portions are of limited longitudinal extent and such that they can be easily and conveniently established by any one of several commonly employed tube flaring or expanding methods and/or procedures.

In the example given, where the clearance between adjacent tubes T is 0.2 inches, the radii of the lobes and grooves L' and G', at the ends of the tubes T, need only be increased and decreased 0.10 inches respectively. Such increases and decreases are minimal and seldom present a manufacturing problem.

If the enlarged end portions E were only formed to the above extent, small undersirable openings or windows corresponding to the windows X in FIG. 2 of the drawings would occur centrally between each three related lobes L' of each three adjacent tubes as shown. To eliminate such openings or windows, the enlarged end portions E of the tubes are further formed, at diametrically opposite sides of each lobe L' to effect closing of the windows X between adjacent related tubes and assure substantial complete uninterrupted contact of opposite surfaces of related end portions E' of said adjacent tubes. The foregoing second an last forming operation can be effected by a suitable coining operation after the end portions are initially formed and constitutes little more than a final adjustment.

The headering means M next includes a header plate P (see FIG. 6 of the drawings). The plate P is a frame-like unit which extends about the end portions of the group or bundle of tubes T making up the core of tubes for the heat exchanger A. The inner periphery of the frame-like plate, which opposes the outwardly disposed sides and/or surfaces of the end portions E of the outside tubes T of the assembly of tubes is machined or otherwise formed to cooperatively receive the opposing portions of the end portions E of the tubes T adjacent to the plate so that close uniform engagement is established therebetween.

When the assembly of tubes T and header plates P is made up, the several opposing and engaging surfaces are fixed together by a suitable cement, soldering, welding or any other suitable bonding means or process, to establish a rigid, strong integrated and suitably sealed core assembly.

It is important to note that the headering means M that I provide lends itself to easy quick and economical manufacturing and assembling techniques and procedures.

The inlet and outlet end of the core assembly is free of extensive flat surfaces and the like about and between the enlarged open ends of adjacent tubes which might block and adversely affect the free flow of fluid flowing to and from the core assembly, as is commonly encountered in core assemblies established in accordance with the prior art where headering means commonly includes flat header plates with spaced through openings in and through which the open ends of the tubes are engaged and set.

Further, and more important, the headering means M that I provide is light-weight and contains no great mass of material which is likely to collect and store heat and which might result in the generating of undesirable thermal stresses in and throughout the core assembly.

In practice, in some instances and/or when certain fluid mediums are conducted through the tubes T, the inside cross-sectional configuration of the tubes might result in the establishing of several substantially separate flow streams through each tube. That is, there is apt to be inadequate commingling of that fluid within the centers and within the several lobes of the tubes to attain desired and effective heat exchange.

Figure 7:
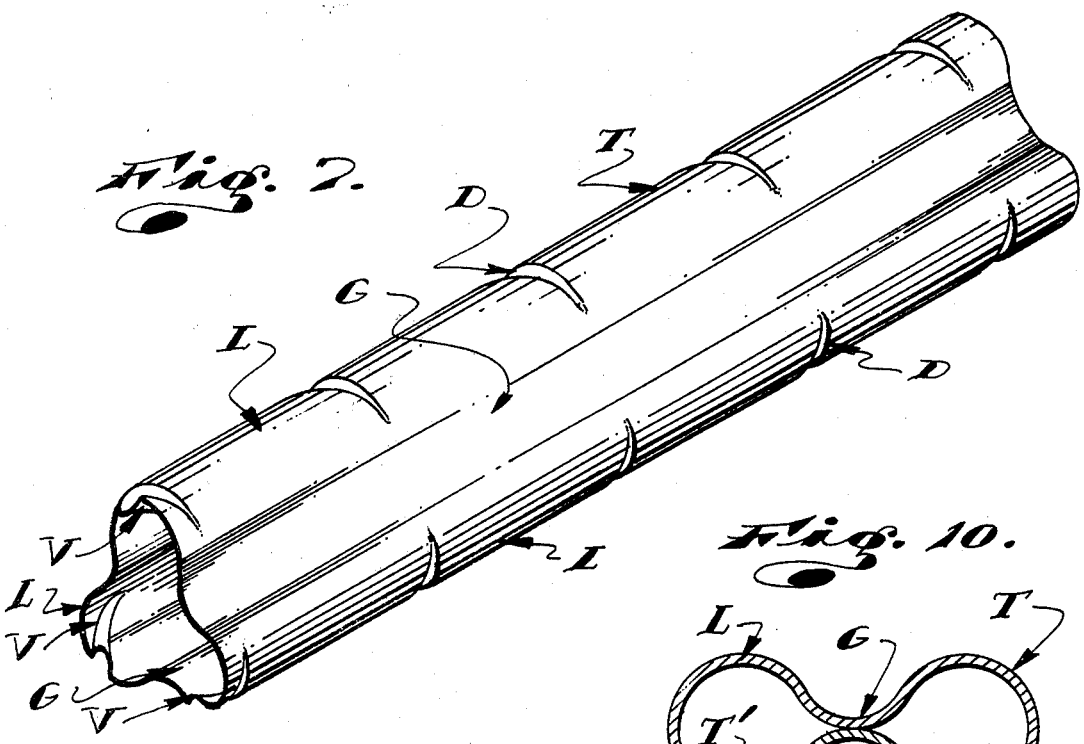
FIG. 7 is an isometric view of a tube with flow directing means formed in it.

In those instances and as shown in FIG. 7 of the drawings, where the above is likely to occur, I provide the lobes L of the tubes T with longitudinal spaces elongate longitudinally and circumferentially inclined, radially inwardly projecting vanes V. The vanes V are established by elongate suitably angularly disposed depressions D formed in the outermost portions of the tube wall defining the lobes L. The vanes V induce the fluid flowing longitudinally through the lobes L of the tubes T to turn or rotate in such a manner that it continuously commingles with the fluid in the centers of the tubes. The above commingling of fluid is such that the fluid is caused to continuously scrub all interior surfaces of the tube and assures most effective and efficient heat exchange therebetween.

In practice, by varying the shape, size, angular disposition, number and spacing of the vanes V, the action or turbulation of the fluid medium within the tubes T can be made to attain a wide range of end results which can be utilized to meet the overwhelming number of anticipated requirements.

In practice, counter-reactive vanes V can be provided to create substantially random turbulation of fluid in the lobes of the tubes, which would be particularly effective to assure desired heat exchange in certain circumstances.

While I have shown the vanes located in the outer portions of the lobes L of the tubes T, it will be apparent that they can be located at any location within the tube structures where their formation is not made impossible or impractical by dimensional limitations.

Figure 10:
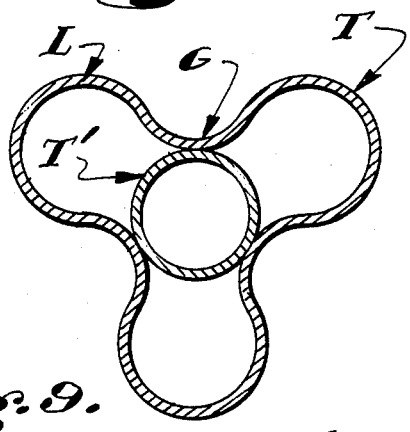
FIG. 10 is a view taken substantially as indicated by line 10—10 on FIG. 9.

In carrying out my invention, when my fluted tubes are subjected to high (inside and outside) pressure differentals which are likely to result in expansive or compressive distortion of the tubes, the tubes T can be provided with central support tubes T', as shown in FIG. 10 of the drawings, The outside diameter of the tubes T' are the same as the minor inside diameter of the tubes T so that the tubes T tangentially engage the inside diameter of the grooved portions of the tubes T. The tubes T' have perforations (not shown) to allow for the free flow of fluid throughout the entire cross-section of the tubes T. The tubes T' can be spot-welded, soldered, cemented or otherwise fixed in and with the tubes T.

The likelihood that support tubes T' might be required or desired, increases as the depth of the grooves G and/or radial extent of the lobes L of the tubes T increases. This is due to the fact that as the radial extent of the grooves and lobes of the tubes T is increased, the strength or stiffness of the tubes, circumferentially, is lessened and the tubes are more subject to being distorted by the application of internal and/or external pressures.

Figure 8:
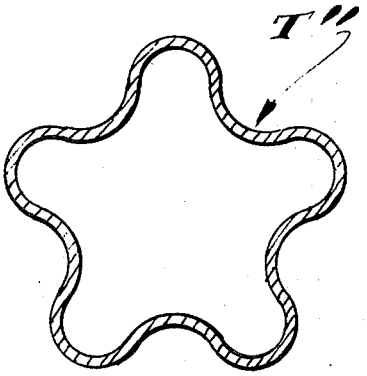
FIG. 8 is a cross-sectional view of another form of fluted tube that I provide.

While I have thus far limited this disclosure to cloverleaf tubes having three lobes and three grooves, it will be apparent that in practice, the number of grooves and lobes can be increased to for example, 5, 7, 9 or more in number, without departing from the broader aspects and spirit of my invention. In FIG. 8 of the drawings, I have shown the cross-section of a tube T" formed with five lobes L" and five grooves G". It will be apparent that a plurality of tubes T" can be related one to the other, to establish a core assembly for a heat exchanger, in the same manner that the tubes T in the first described form of my invention are related.

Figure 9:
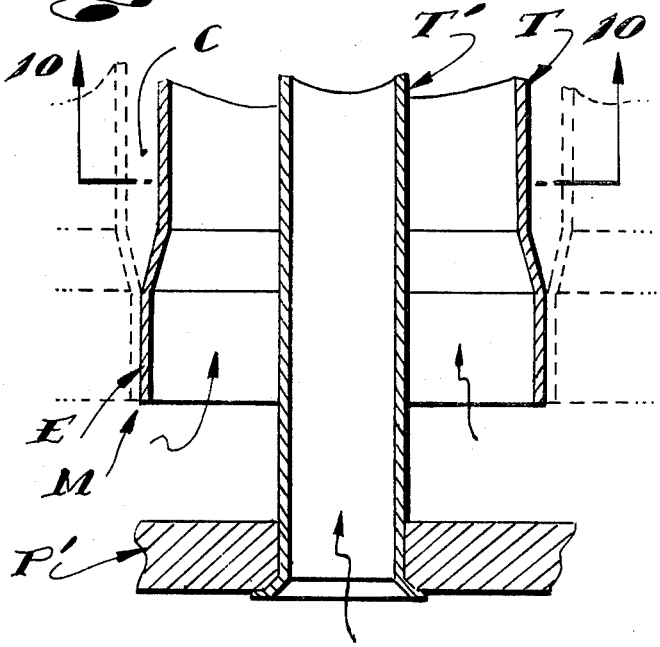
FIG. 9 is a view of another form of my invention.

Finally, in FIG. 9 of the drawings, and in FIG. 10 of the drawings, I have shown a form of my invention which is intended to suitably and effectively handle three fluid mediums. In this form of the invention, I provide outside, fluted, primary tubes T to conduct one medium and central flow tubes T', within the tubes T, to conduct a second medium. The third medium is that medium which is conducted across and about the exterior of the tubes T.

In this embodiment of my invention, the central flow tubes T' are essentially the same as the previously described perforated support tubes T', but are not preforated and have end portions which extend axially outward from the headered end portions E' of the tubes T. The extended end portions of the tubes T' extend through related openings in header plates P' and are flared or otherwise sealingly secured in the plates P', in accordance with common practice.

In core assemblies embodying the last noted form of my invention, the header plates P' are spaced axially outward from the headered ends of the fluted tubes T to cooperate therewith to define the axial outer walls of those chambers through which the medium flowing through the tubes T flows and axial inner walls of the chambers or other means through which the medium flowing through the tubes T' flow.

In those forms of my invention in which central supporting tubes are provided within the fluted tubes, whether the central supporting tubes are perforated tubes or non-perforated tubes, the inner cylindrical tubes impart substantial structural stability to the tube assemblies and make feasible the establishing of core assemblies which are substantially greater in longitudinal extent than can be established with common cylindrical tubes of comparable size and weight.

In addition to the foregoing, the fluted tubes that I provide are notably less subject to sagging and bending than are tubes of cylindrical cross-section. Further, when fluted tubes such as I provide are subjected to shock vibrating forces and/or high velocity cross-flow, they are not subject to being set into harmonic motion or the like which is a notable cause of fatique and failure in many of those heat exchanger structures provided by the prior art wherein straight cylindrical tubes are employed.

Having described only typical preferred forms and applications of my invention, I do not wish to be limited to the specific details herein set forth, but wish to reserve to myself any modifications and/or variations that may appear to those skilled in the art and which fall within the scope of the following claims:

Having described my invention I claim:

1. A heat exchanger comprising a plurality of elongate parallel fluid medium conducting tubes, a first fluid handling means communicating with the opposite ends of the tubes to deliver a first fluid medium into one end and to receive said medium at the other end thereof, a second fluid handling means directing a second fluid medium about the exterior of and between the tubes, each tube is formed with an uneven number of circumferentially spaced longitudinally extending grooves and circumferentially spaced longitudinally extending lobes, each lobe occurs between a pair of adjacent grooves, the grooves have concave substantially radially outwardly disposed outside bottom surfaces and the lobes have substantially radially outwardly disposed convex outside surfaces, the radius of said convex surfaces is less than the radius of said concave surfaces, the lobes at the sides of each tube projecting toward adjacent tubes extend to the related grooves of said adjacent tubes with the concave and convex surfaces of the related lobes and grooves in spaced relationship.

2. The heat exchanger set forth in claim 1 wherein the space between the opposing surfaces of inter-engaged grooves and lobes is substantially the same throughout the assembly of tubes.

3. The heat exchanger set forth in claim 1 wherein the opposite end portions of the grooves and lobes of each tube are expanded so that the radius of the concave and convex surfaces thereof are equal and whereby the opposing concave and convex surfaces of related grooves and lobes of adjacent tubes establish substantial uniform engagement with each other and means bonding said engaging surfaces together and sealing the spaces between adjacent tubes throughout the end portions of the assembly of tubes.

4. The heat exchanger set forth in claim 1 wherein the radial outer portions of the lobes of the tubes are formed with longitudinally spaced circumferentially and longitudinally inclined elongate radially inwardly projecting vanes to cause the medium flowing longitudinally therethrough to rotate and scrub the interior surface of the lobes, the rotating medium in each lobe joins the medium flowing longitudinally through the tubes radially inward of the lobes and grooves and causes that medium to rotate.

5. The heat exchanger set forth in claim 3 wherein the radial outer portions of the lobes of the tubes are formed with longitudinally spaced circumferentially and longitudinally inclined elongate radially inwardly projecting vanes to cause the medium flowing longitudinally therethrough to rotate and scrub the interior surface of the lobes, the rotating medium in each lobe joins the medium flowing longitudinally through the tubes radially inward of the lobes and grooves and causes that medium to rotate.

6. The heat exchanger set forth in claim 1 wherein the radial outer portions of the lobes of the tubes are formed with longitudinally spaced circumferentially and longitudinally inclined elongate radially inwardly projecting vanes to cause the medium flowing longitudinally therethrough to rotate and scrub the interior surface of the lobes, the rotating medium in each lobe joins the medium flowing longitudinally through the tubes radially inward of the lobes and grooves and causes that medium to rotate, said vanes are established by elongate radially outwardly opening axially and circumferentially disposed depressions formed in the walls of the tubes.

7. The heat exchanger set forth in claim 3 wherein the radial outer portions of the lobes of the tubes are formed with longitudinally spaced circumferentially and longitudinally inclined elongate radially inwardly projecting vanes to cause the medium flowing longitudinally therethrough to rotate and scrub the interior surface of the lobes, the rotating medium in each lobe joins the medium flowing longitudinally through the tubes radially inward of the lobes and grooves and causes that medium to rotate, said vanes are established by elongate radially outwardly opening axially and circumferentially disposed depressions formed in the walls of the tubes.

8. The heat exchanger set forth in each of claims 1, 2, 3, 4, 5 and 6 which further includes elongate cylindrical inside tubes extending longitudinally through and in supporting engagement with the innermost surfaces of the grooves formed in the outer formed tubes and means fixing the inside and outer tubes together.

9. The heat exchanger set forth in each of claims 1, 2, 3, 4, 5 and 6 which further includes elongate cylindrical inside flow tubes extending longitudinally through and axially outward from the opposite ends of the first recited formed tubes, said flow tubes engage and are fixed to the groove portions of the formed tubes and, a third fluid handling means communicating with the opposite ends of the flow tubes directing a third fluid medium into one end of and receiving that third fluid medium flowing from the other ends of said flow tubes.

* * * * *